US005934359A

United States Patent [19]

Strezov

[11] Patent Number: 5,934,359

[45] **Date of Patent: *Aug. 10, 1999**

[54] CASTING STEEL STRIP

[75] Inventor: Lazar Strezov, Adamstown, Australia

[73] Assignees: Ishikawajima-Harima Heavy Industries Company Limited, Tokyo, Japan; BHP Steel (Jla) Pty Ltd, Melbourne, Australia

[ * ] Notice: This patent is subject to a terminal disclaimer.

[21] Appl. No.: 08/845,027

[22] Filed: Apr. 21, 1997

[30] Foreign Application Priority Data

Apr. 19, 1996 [AU] Australia ..... PN9376

[51] Int. Cl.[6] ..... B22D 11/06; B22D 11/07

[52] U.S. Cl. ..... 164/480; 164/472

[58] Field of Search ..... 164/428, 480, 164/429, 479, 472, 122

[56] References Cited

U.S. PATENT DOCUMENTS 5,720,336 2/1998 Strezov ..... 164/480

*Primary Examiner*—Kuang Y. Lin

*Attorney, Agent, or Firm*—Nikaido, Marmelstein, Murray & Oram LLP

[57] ABSTRACT

Method of casting steel strip in which molten steel solidifies as a shell on a chilled casting surface (100). The casting surface (100) has a texture (101) formed by a regular pattern of surface projections (103) and depressions (102) and the steel chemistry is selected to generate in the casting pool deoxidation products which form on the casting surface (100) a layer of less than 5 microns thickness a major proportion of which is liquid during cooling of the steel to below its liquidus temperature in the formation of said solidified shell. The substantially liquid layer suppresses the formation of surface defects in the solidifying metal surface due to early deposition of solid oxides on the casting surface.

21 Claims, 17 Drawing Sheets

CASTING STEEL STRIP

BACKGROUND OF THE INVENTION

This invention relates to the casting of steel strip.

It is known to cast metal strip by continuous casting in a twin roll caster. In this technique molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow, although alternative means such as electromagnetic barriers have also been proposed.

Although twin roll casting has been applied with some success to non-ferrous metals which solidify rapidly on cooling, there have been problems in applying the technique to the casting of ferrous metals. One particular problem has been the achievement of sufficiently rapid and even cooling of metal over the casting surfaces of the rolls. In particular it has proved difficult to obtain sufficiently high cooling rates for solidification onto casting rolls with smooth casting surfaces and it has therefore been proposed to use rolls having casting surfaces which are deliberately textured by a regular pattern of projections and depressions to enhance heat transfer and so increase the heat flux achieved at the casting surfaces during solidification.

Although various forms of surface texture have been proposed, we have determined that the most successful texture in terms of achieving increased heat flux during solidification is one formed by a series of parallel groove and ridge formations. More specifically, in a twin roll caster the casting surfaces of the casting rolls may be textured by the provision of circumferentially extending groove and ridge formations of essentially constant depth and pitch. The reasons for the enhanced heat flux obtained with casting surfaces of this formation are fully explained in our Australian Patent Application NO 50775/96 entitled CASTING STEEL STRIP. This application further describes how the texture can be optimised for casting of steel in order to achieve both high heat flux values and a fine microstructure in the as cast steel strip. Essentially when casting steel strip, the depth of the texture from ridge peak to groove root should be in the range 5 microns to 50 microns and the pitch of the texture should be in the range 100 to 250 microns for best results. For optimum results it is preferred that the depth of the texture be in the range 15 to 25 microns and that the pitch be between 150 and 200 microns.

Although the use of textured casting surfaces enables sufficiently high heat flux values to be obtained on solidification to enable satisfactory casting of steel strip the resulting strip can suffer from surface defects caused by deposition of solid oxides on the casting surfaces during initial solidification within the casting pool, the solid sides being present as de-oxidation products in the molten steel. Ferrous metals are particularly prone to deposit solid inclusions by producing oxides in solid form at the casting temperature. The deposition of $Al_2O_3$ is a particular problem. Such deposition can lead to intermittent contact between the textured casting surfaces and the melt at the initial point of contact between the melt and the casting surface in the casting pool (ie the meniscus region) which results in a transverse surface depression in the resulting cast strip, the defect being known as "chatter". We have now determined that it is possible to avoid surface defects caused by deposition of solid oxides (de-oxidation products) by ensuring that each casting surface is covered by a thin layer of material a major proportion of which layer remains liquid as the steel is cooled below its liquidus temperature in the formation of the solidified shell on the casting surface. The interposition of such a substantially liquid layer between the casting surface and the cooling steel in the casting pool can result in substantial under-cooling of the steel below its liquidus temperature before the metal solidification is complete because it suppresses the availability of discrete nucleation sites. Because the layer is substantially liquid during the metal solidification, it suppresses the formation of defects in the solidifying metal surface due to early deposition of solid oxides on the casting surfaces, the term "metal solidification" being used herein to refer to the extended solidification period when the molten steel is cooled below its liquidus temperature.

SUMMARY OF THE INVENTION

According to the invention there is provided a method of casting steel strip of the kind in which molten steel solidifies from a casting pool as a shell on a chilled casting surface, wherein the casting surface is textured by a regular pattern of surface projections and depressions and wherein the molten steel chemistry is selected to generate in the casting pool de-oxidation products which form on the casting surface a layer of less than 5 microns thickness a major proportion of which is liquid during cooling of the steel to below its liquidus temperature in the formation of said solidified shell.

The casting pool may contain oxides of iron, manganese and silicon and said layer may comprise a mixture of iron, manganese and silicon oxides, the proportions of the mixture being such that a major proportion of the mixture is liquid during metal solidification.

The molten steel may be a manganese/silicon killed steel. In that case, it is preferred that the free oxygen level of the steel is controlled such that said layer is comprised essentially of a mixture of $MnO+SiO_2$ at the casting temperature, although a small proportion of $Al_2O_3$ may be tolerated.

The free oxygen level of the steel may be controlled by trimming in a supply ladle prior to casting.

The slag of the pool may also comprise aluminium oxide. For example, the steel melt may be an aluminium killed steel which generates significant quantities of $Al_2O_3$ in the slag. In this case, the steel melt may have a purposeful addition of calcium so as to reduce the precipitation of solid $Al_2O_3$.

The method of the invention may be carried out in a twin roll caster.

Accordingly the invention further provides a method of continuously casting steel strip of the kind in which molten steel is introduced into the nip between a pair of parallel casting rolls via a metal delivery nozzle disposed above the nip to create a casting pool of molten steel supported on chilled casting surfaces of the rolls immediately above the nip, whereby the molten steel solidifies as shells on the casting surfaces, and the casting rolls are rotated to bring the solidified shells together into a solidified steel strip delivered downwardly from the nip, wherein the casting surfaces of the rolls are each textured by the provision of a regular pattern of surface projections and depressions and wherein the molten steel chemistry is selected to generate in the casting pool de-oxidation products which form on each roll casting surface a layer of less than 5 microns thickness a major proportion of which is liquid during cooling of the steel to below its liquidus temperature in the formation of said solidified shells.

It is preferred that the liquid fraction in the layer be at least 0.75. More particularly it is preferred that the layer be substantially all liquid during the steel solidification.

BRIEF DESCRIPTION OF THE DRAWINGS

In order that the invention may be more fully explained some particular examples will be described with reference to the accompanying drawings in which.

DESCRIPTION OF PREFERRED EMBODIMENT

Figure 1:
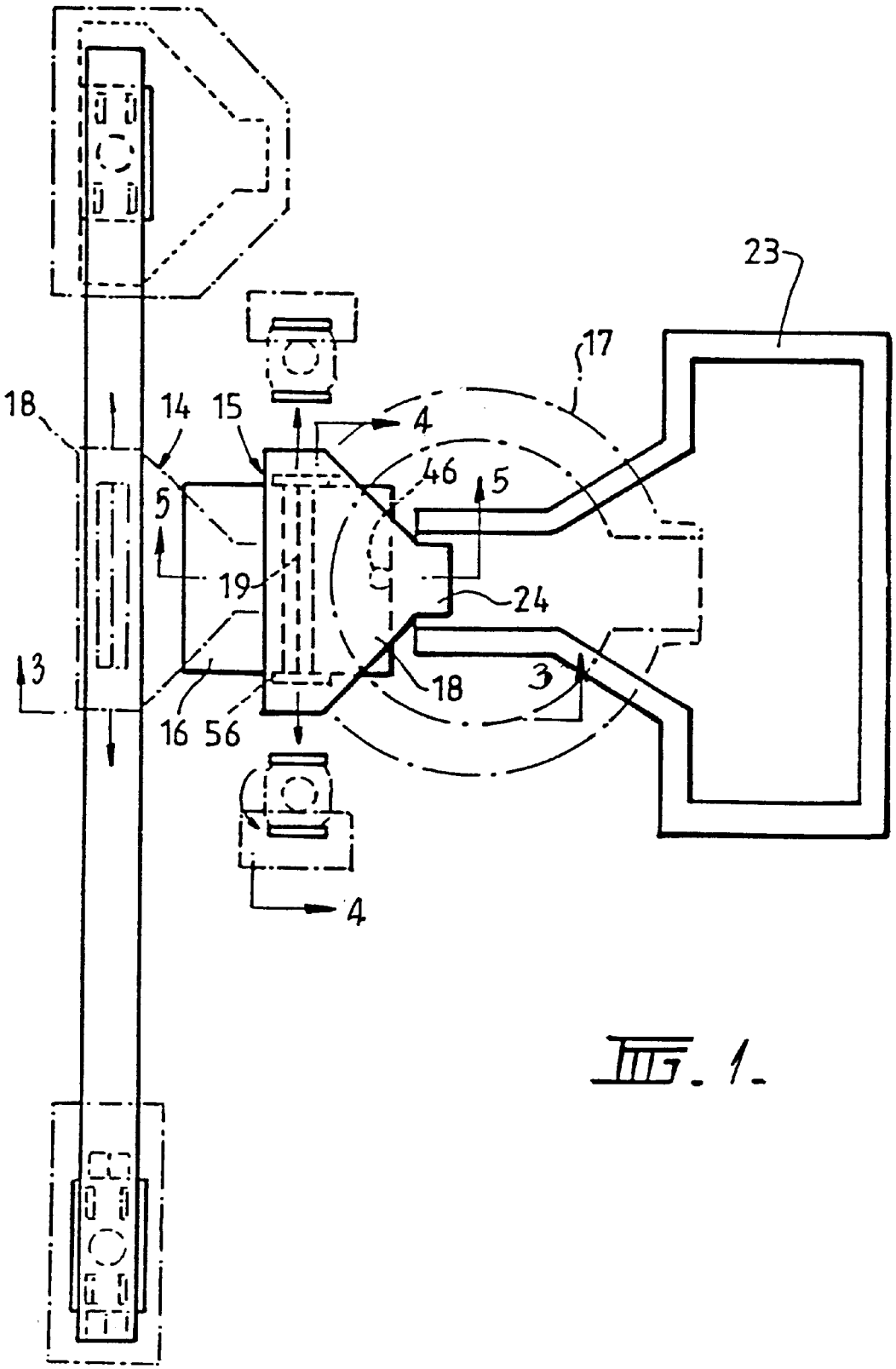
FIG. 1 is a plan view of a continuous strip caster.
Figure 2:
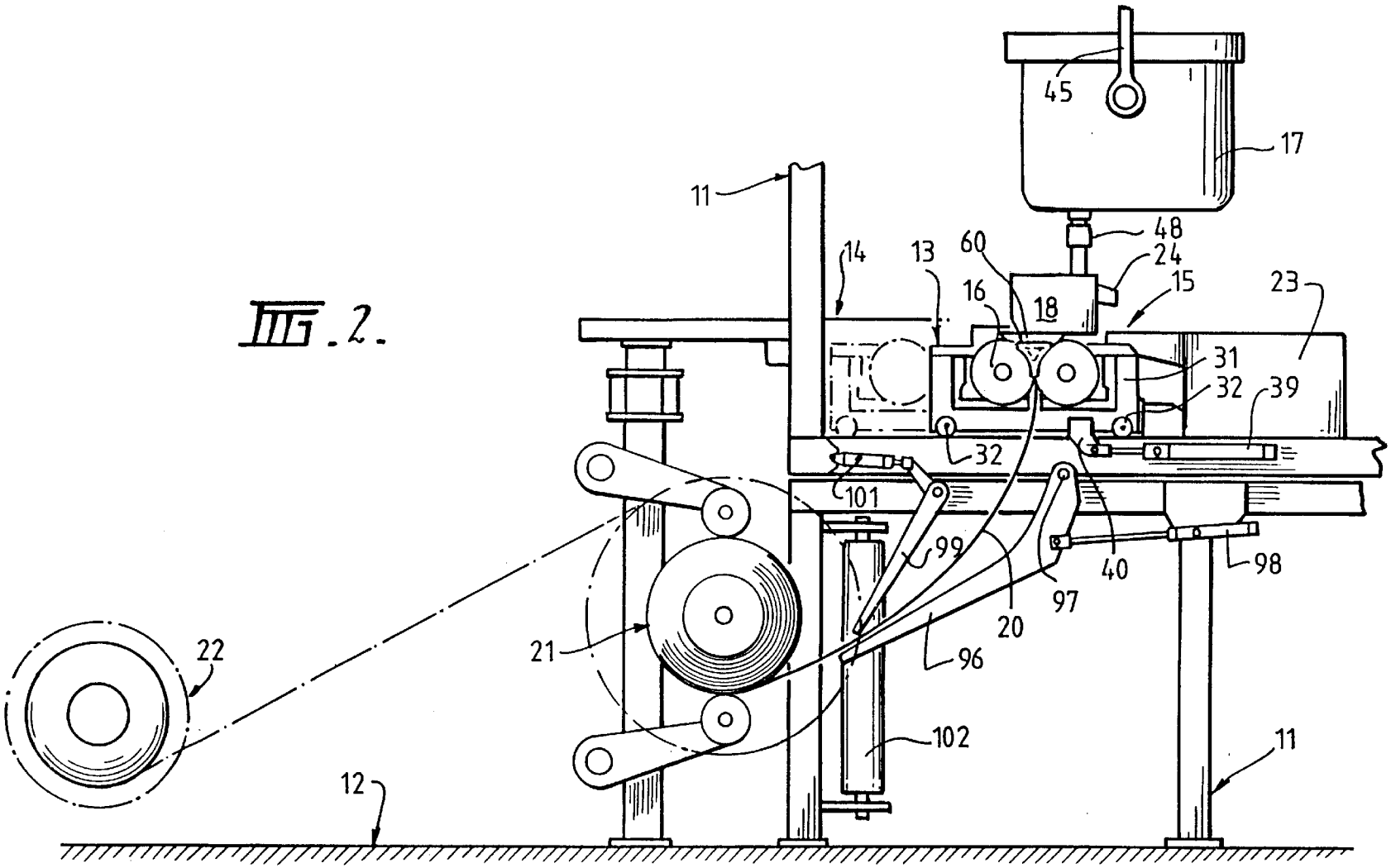
FIG. 2 is a side elevation of the strip caster shown in FIG. 1.
Figure 3:
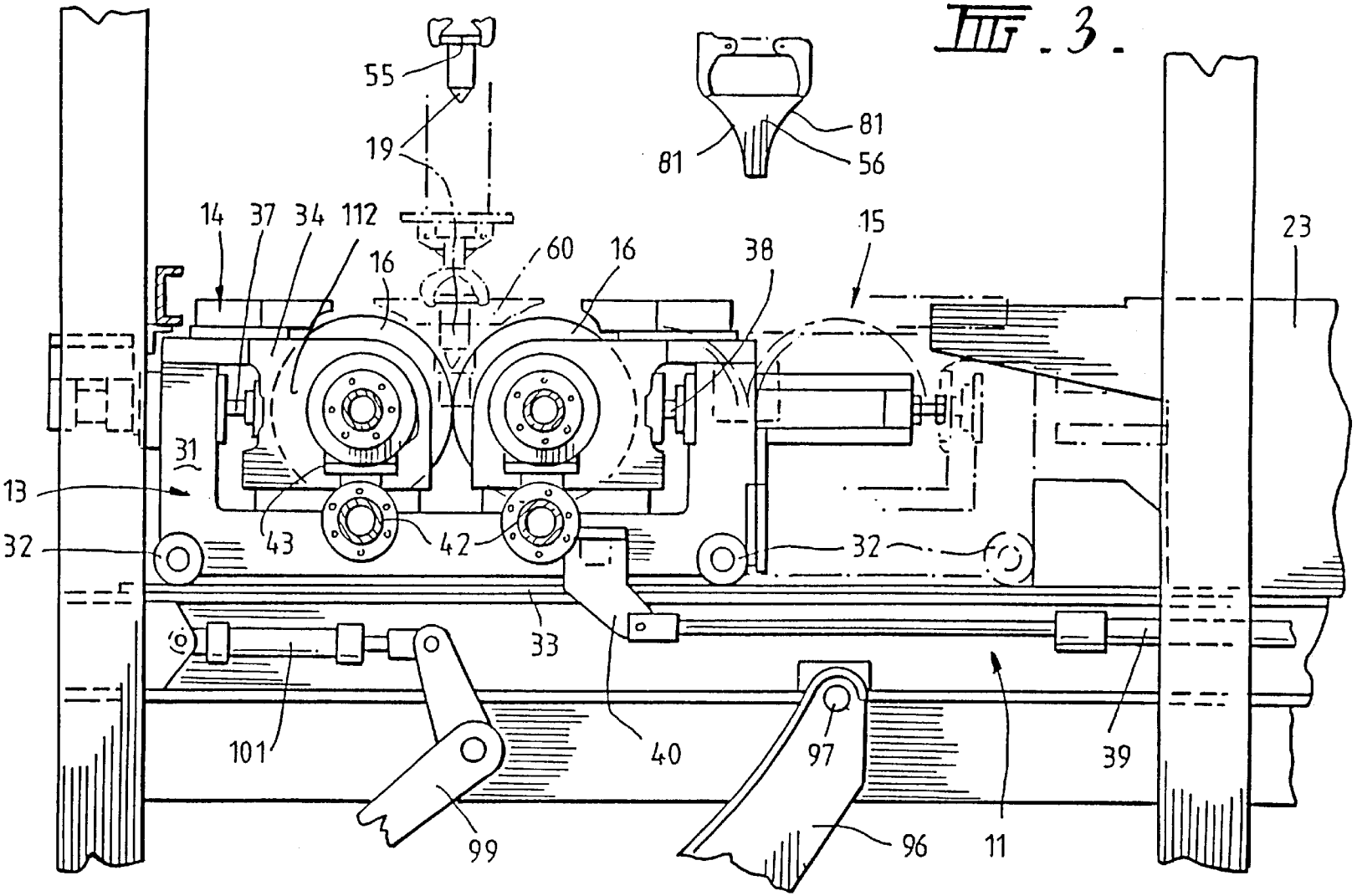
FIG. 3 is a vertical cross-section on the line 3—3 in FIG. 1.
Figure 4:
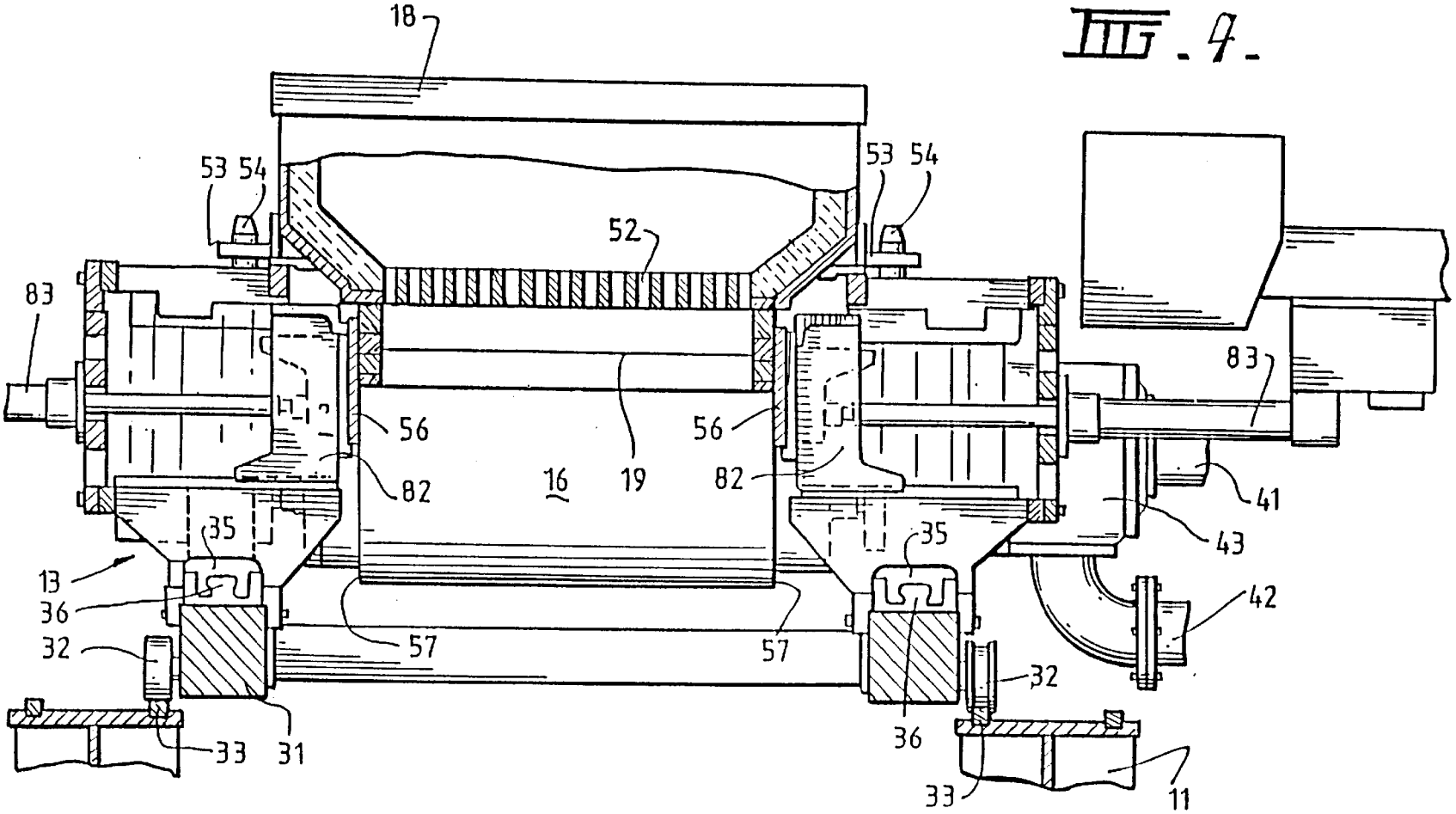
FIG. 4 is a vertical cross-section on the line 4—4 in FIG. 1.
Figure 5:
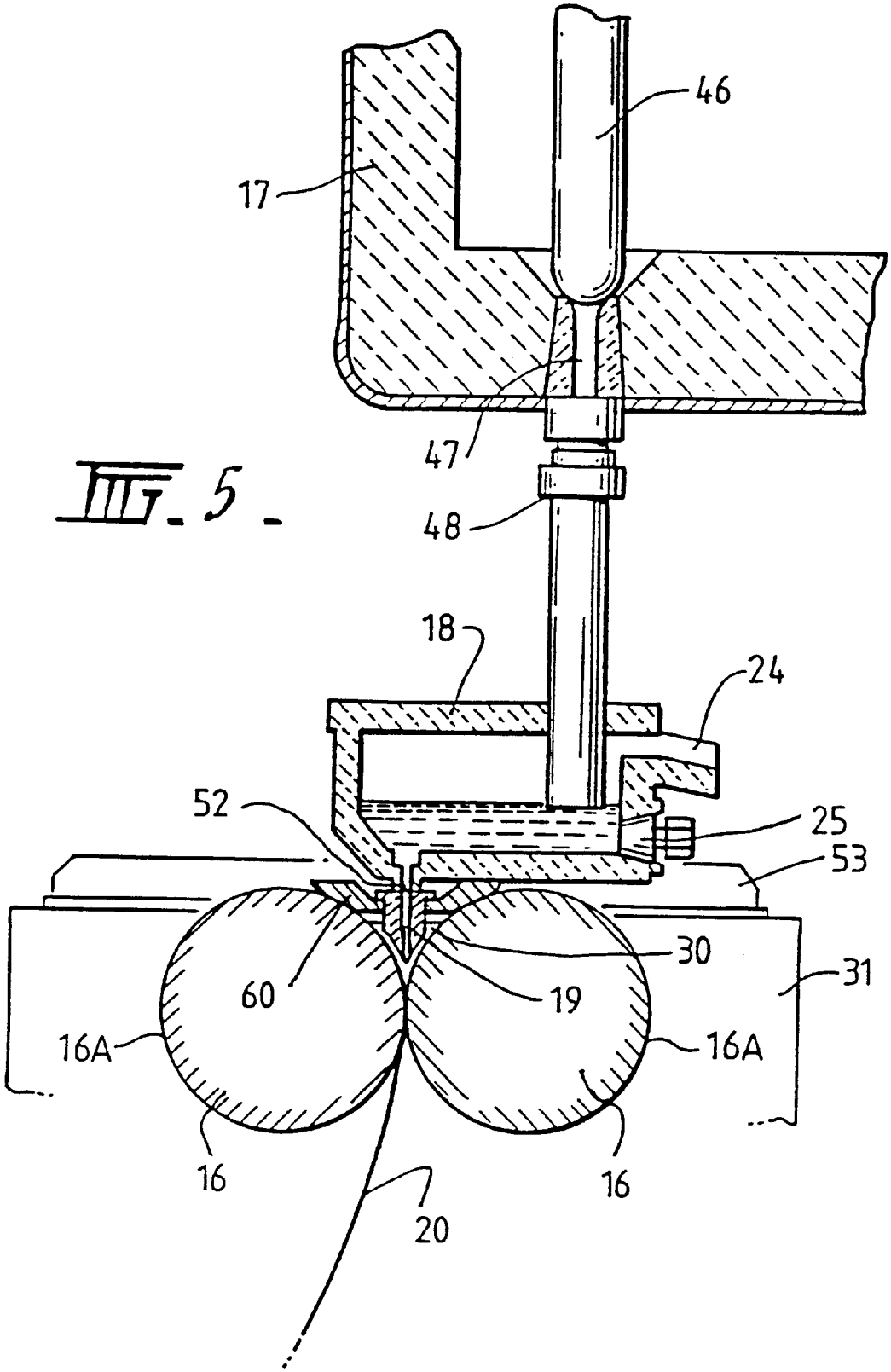
FIG. 5 is a vertical cross-section on the line 5—5 in FIG. 1.

FIGS. 1 to 7 illustrate a twin roll continuous strip caster which has been operated in accordance with the present invention. This caster comprises a main machine frame 11 which stands up from the factory floor 12. Frame 11 supports a casting roll carriage 13 which is horizontally movable between an assembly station 14 and a casting station 15. Carriage 13 carries a pair of parallel casting rolls 16 to which molten metal is supplied during a casting operation from a ladle 17 via a tundish 18 and delivery nozzle 19 to create a casting pool 30. Casting rolls 16 are water cooled so that shells solidify on the moving roll surfaces 16A and are brought together at the nip between them to produce a solidified strip product 20 at the roll outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the tundish or by withdrawal of an emergency plug 25 at one side of the tundish if there is a severe malformation of product or other severe malfunction during a casting operation.

Roll carriage 13 comprises a carriage frame 31 mounted by wheels 32 on rails 33 extending along part of the main machine frame 11 whereby roll carriage 13 as a whole is mounted for movement along the rails 33. Carriage frame 31 carries a pair of roll cradles 34 in which the rolls 16 are rotatably mounted. Roll cradles 34 are mounted on the carriage frame 31 by interengaging complementary slide members 35, 36 to allow the cradles to be moved on the carriage under the influence of hydraulic cylinder units 37, 38 to adjust the nip between the casting rolls 16. The carriage is movable as a whole along the rails 33 by actuation of a double acting hydraulic piston and cylinder unit 39, connected between a drive bracket 40 on the roll carriage and the main machine frame so as to be actuable to move the roll carriage between the assembly station 14 and casting station 15 and vice versa.

Casting rolls 16 are contra rotated through drive shafts 41 from an electric motor and transmission mounted on carriage frame 31. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The roll may typically be about 500 mm diameter and up to 2000 mm long in order to produce 2000 mm wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into tundish 18.

Tundish 18 is also of conventional construction. It is formed as a wide dish made of a refractory material such as magnesium oxide (MgO). One side of the tundish receives molten metal from the ladle and is provided with the aforesaid overflow 24 and emergency plug 25. The other side of the tundish is provided with a series of longitudinally spaced metal outlet openings 52. The lower part of the tundish carries mounting brackets 53 for mounting the tundish onto the roll carriage frame 31 and provided with apertures to receive indexing pegs 54 on the carriage frame so as to accurately locate the tundish.

Delivery nozzle 19 is formed as an elongate body made of a refractory material such as alumina graphite. Its lower part is tapered so as to converge inwardly and downwardly so that it can project into the nip between casting rolls 16. It is provided with a mounting bracket 60 whereby to support it on the roll carriage frame and its upper part is formed with outwardly projecting side flanges 55 which locate on the mounting bracket.

Nozzle 19 may have a series of horizontally spaced generally vertically extending flow passages to produce a suitably low velocity discharge of metal throughout the width of the rolls and to deliver the molten metal into the nip between the rolls without direct impingement on the roll surfaces at which initial solidification occurs. Alternatively, the nozzle may have a single continuous slot outlet to deliver a low velocity curtain of molten metal directly into the nip between the rolls and/or it may be immersed in the molten metal pool.

The pool is confined at the ends of the rolls by a pair of side closure plates 56 which are held against stepped ends 57 of the rolls when the roll carriage is at the casting station. Side closure plates 56 are made of a strong refractory material, for example boron nitride, and have scalloped side edges 81 to match the curvature of the stepped ends 57 of the rolls. The side plates can be mounted in plate holders 82 which are movable at the casting station by actuation of a pair of hydraulic cylinder units 83 to bring the side plates into engagement with the stepped ends of the casting rolls to form end closures for the molten pool of metal formed on the casting rolls during a casting operation.

During a casting operation the ladle stopper rod 46 is actuated to allow molten metal to pour from the ladle to the tundish through the metal delivery nozzle whence it flows to the casting rolls. The clean head end of the strip product 20 is guided by actuation of an apron table 96 to the jaws of the coiler 21. Apron table 96 hangs from pivot mountings 97 on the main frame and can be swung toward the coiler by actuation of an hydraulic cylinder unit 98 after a head end of the strip has been formed. Table 96 may operate against an upper strip guide flap 99 actuated by a piston and a cylinder unit 101 and the strip product 20 may be confined between a pair of vertical side rollers 102. After the head end has been guided in to the jaws of the coiler, the coiler is rotated to coil the strip product 20 and the apron table is allowed to swing back to its inoperative position where it simply hangs from the machine frame clear of the product which is taken directly onto the coiler 21. The resulting strip product 20 may be subsequently transferred to coiler 22 to produce a final coil for transport away from the caster.

Full particulars of a twin roll caster of the general kind illustrated in FIGS. 1 to 5 are more fully described in our U.S. Pat. Nos. 5,184,668 and 5,277,243 and International Patent Application PCT/AU93/00593.

Figure 6:
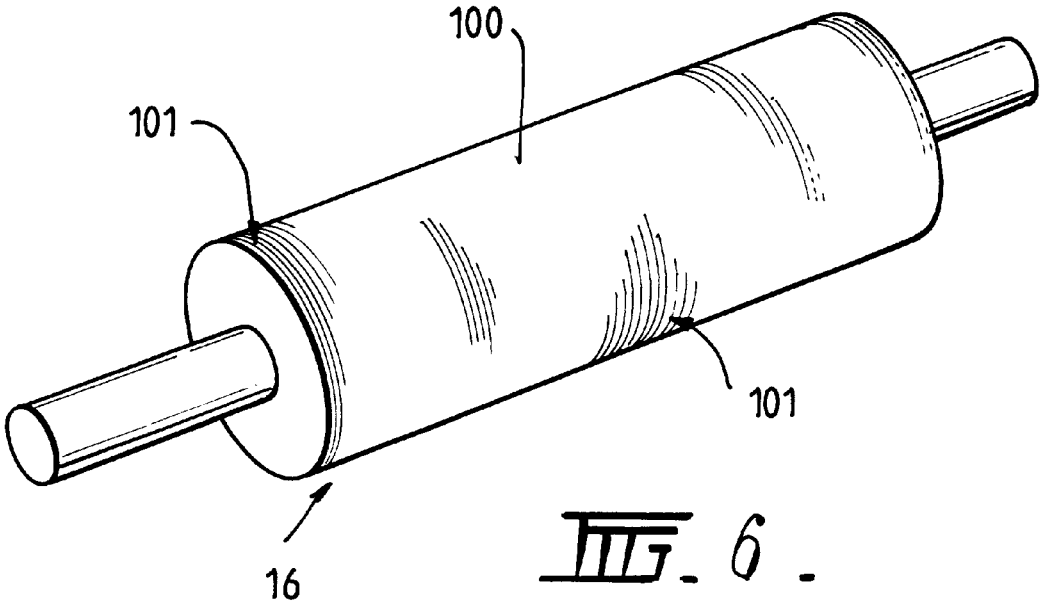
FIG. 6 illustrates a casting roll with a preferred form of textured surface.
Figure 7:
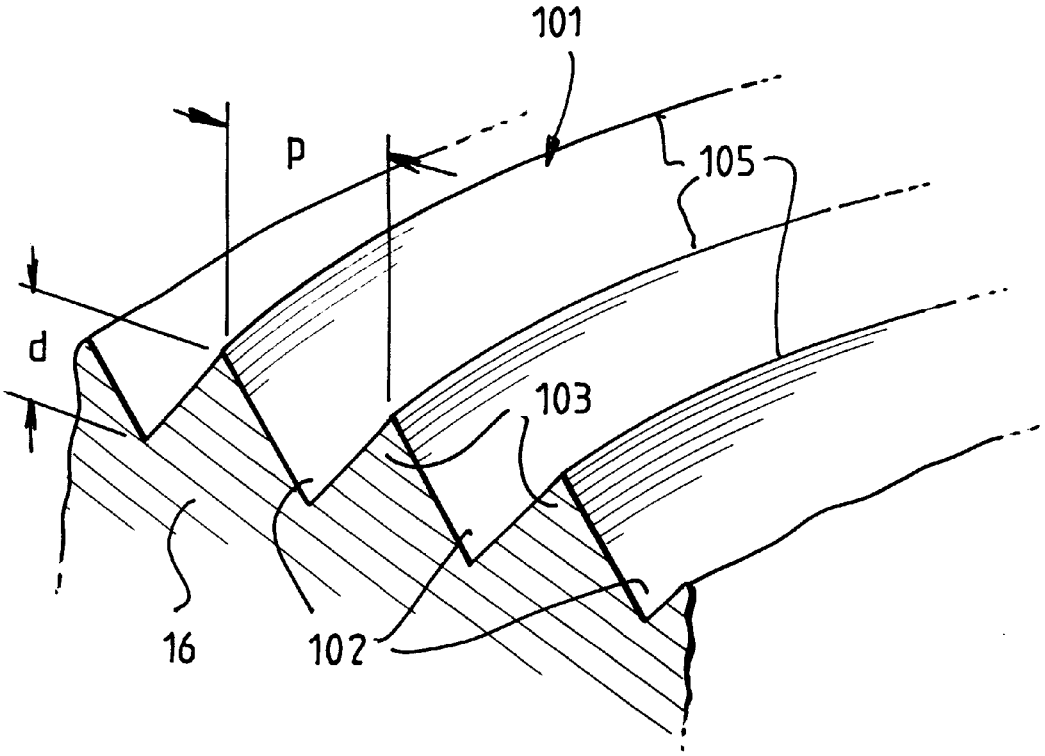
FIG. 7 is an enlarged schematic diagram of the preferred kind of texture.

The preferred form of texture for the casting surfaces of the rolls 16 is illustrated in FIGS. 6 and 7. As shown in these figures the casting surface 100 of each roll is provided with circumferential groove and ridge formations 101 which are shown to an enlarged scale in FIG. 7. They define a series of circumferential grooves 102 of V-shaped cross-section and between the grooves are series of parallel ridges 103 having sharp circumferential edges 105. The groove and ridge formations define a texture having a depth from ridge peak to groove root indicated as d in FIG. 7. The pitch between the regularly spaced ridges is indicated by p in FIG. 7.

As more fully explained in our Australian Patent Application No 50775/96 entitled CASTING STEEL STRIP, the sharp edges of the ridges in textured casting surfaces of the kind illustrated in FIGS. 6 and 7 provide lines of closely spaced nucleation sites during metal solidification. The spacing or frequency of the nucleation sites along the ridges determines the maximum heat flux. The nucleation frequency along each ridge depends on the pitch between the ridges and it is possible to optimise the texture for obtaining high heat flux values and a fine microstructure in the resulting as cast steel strip. Best results have been obtained with surface textures having a ridge pitch in the range 150 to 250 microns and a texture depth of between 5 microns and 50 microns, a texture having a depth of 20 microns and a pitch of 180 microns being particularly effective.

Various grades of steel strip have been cast in apparatus as illustrated in FIGS. 1 to 7. In particular there has been extensive casting of silicon/manganese killed steel having carbon, manganese and silicon contents in the following ranges:

| | |
|---|---|
| Carbon | 0.02–0.15% by weight |
| Manganese | 0.20–1.0% by weight |
| Silicon | 0.10–0.5% by weight. |

It has been found that to avoid the deposition of $Al_2O_3$ inclusions from steels of this kind it is essential that the total aluminium content of the steel be below 0.01% by weight. Even then however, there is a continuing problem of surface defects in the resulting strip in the form of depressions produced by the deposition of solid oxide particles on the casting surfaces during initial solidification of steel onto those surfaces. The oxide particles leave small imprints which can be seen as depressions in the surface of the resulting strip.

Figure 8:
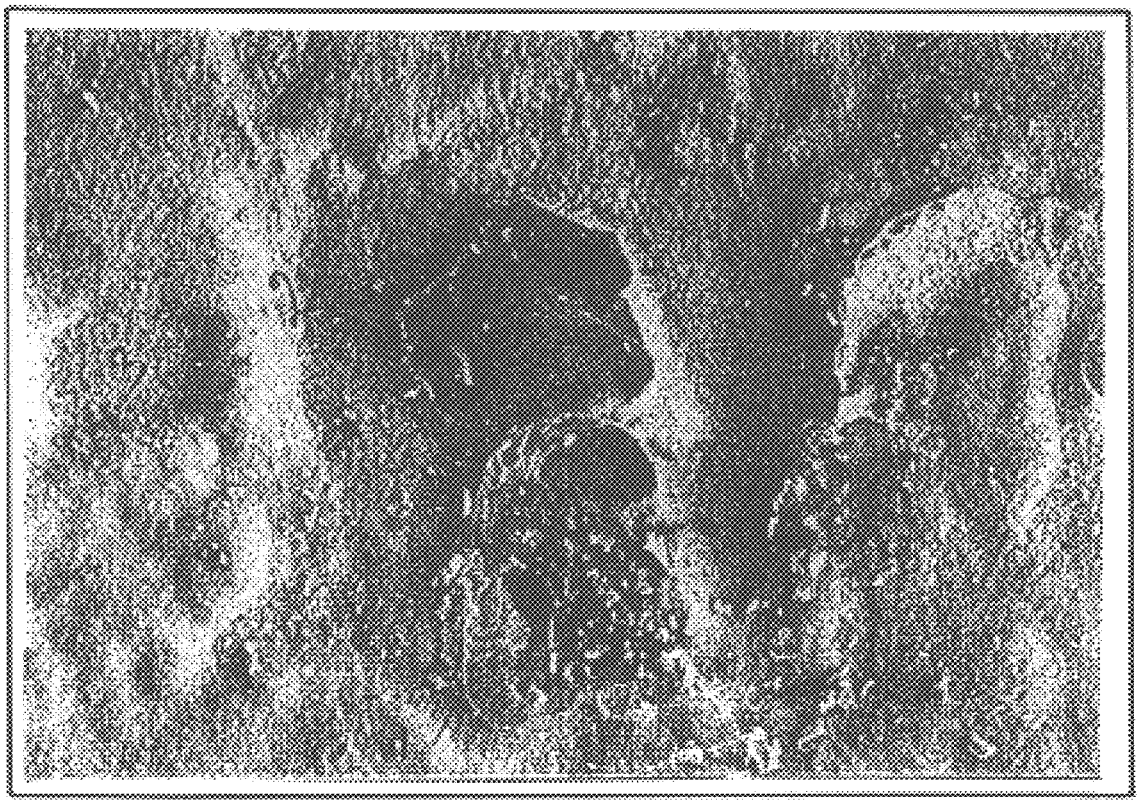
FIG. 8 is a SEM (Scanning electron microscope) micrograph showing the surface of a cast strip.
Figure 9:
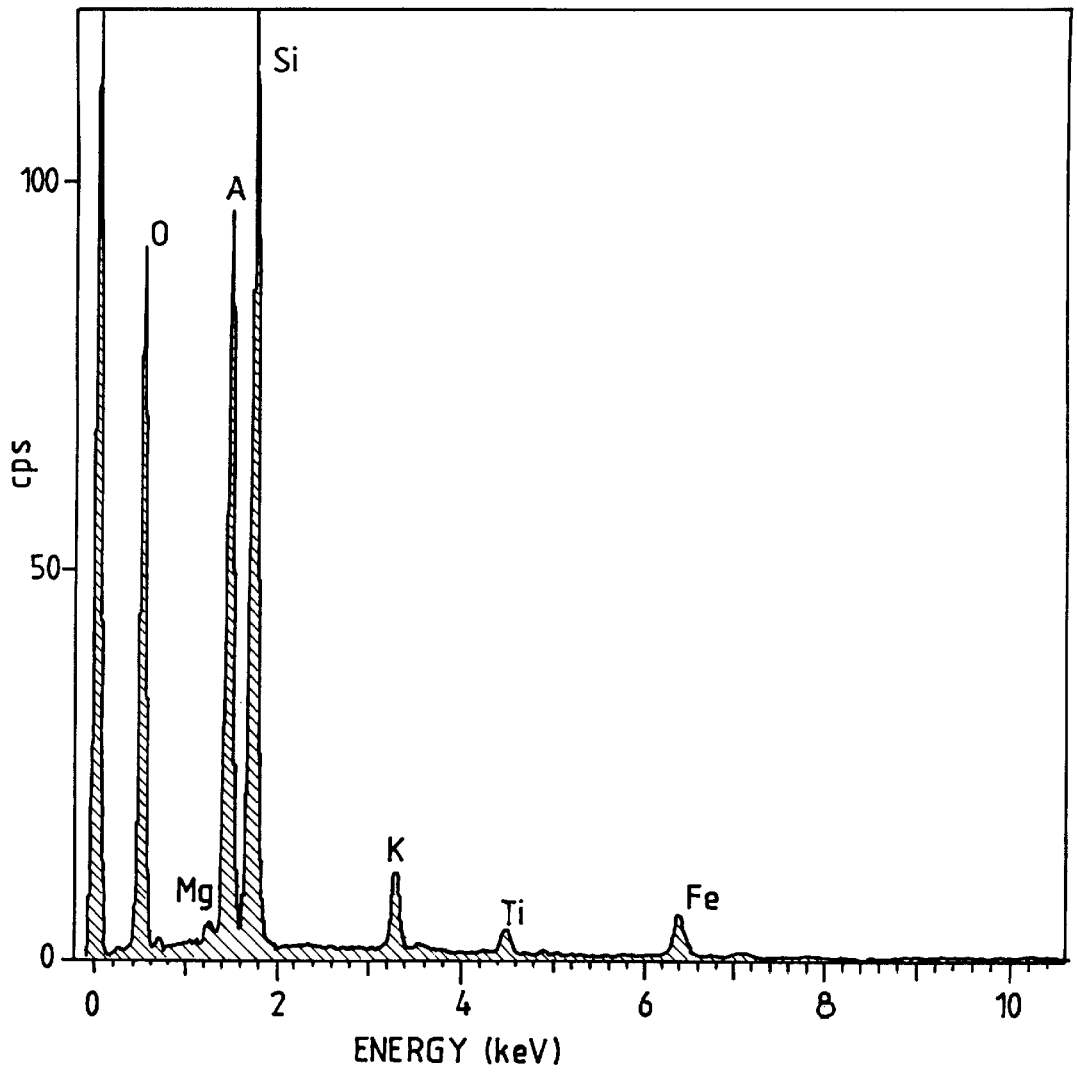
FIG. 9 shows the result of an x-ray microanalysis of material in the surface of the strip illustrated in FIG. 8.

FIG. 8 is a photomicrograph to a very high magnification of a typical M06 steel strip cast on apparatus of the kind illustrated in FIGS. 1 to 7. To significant pit defects can be seen in the central region of this figure. FIG. 9 sets out the results of a qualitative energy dispersive x-ray microanalysis scan of the surface defects in the strip illustrated in FIG. 8. This shows that in the region of the defect there are high concentrations of aluminium and silicon indicating a high concentration of $SiO_2$ and $Al_2O_3$.

Figure 10:
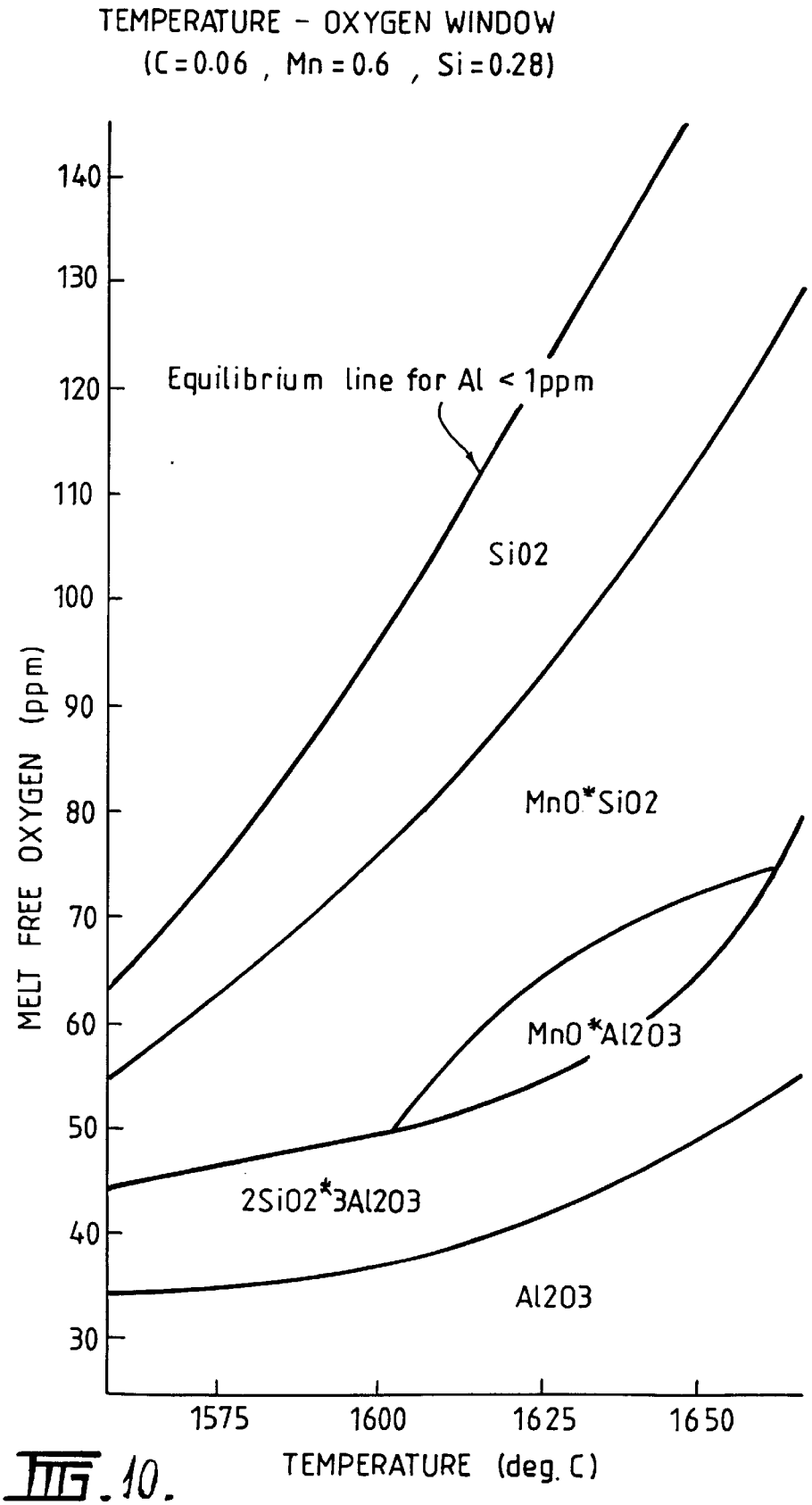
FIG. 10 illustrates the oxide phases present in a melt of manganese/silicon killed steel melt.

FIG. 10 illustrates the oxide phases present in M06 steel over a range of melt temperatures at differing free oxygen levels. It will be seen that at low melt free oxygen levels the oxide phases will be predominantly $Al_2O_3$. At higher oxygen levels the oxide phases will be a mixture of $2SiO_2+3Al_2O_3$. Both these types of oxygen phases are substantially solid and will result in the deposition of solid particles on the casting surfaces. At higher melt free oxygen levels it is possible to obtain oxide phases consisting essentially of $MnO+SiO_2$ which are liquid at the indicated temperatures. If the melt free oxygen level is too high the oxide phases will consist essentially of $SiO_2$ which can deposit as solid particles.

In accordance with the present invention the melt chemistry and free oxygen level should be adjusted in accordance with the casting temperature so as to produce oxide phases consisting essentially of $MnO+SiO_2$. It will be seen that there is a small region which produces oxide phases of $MnO+Al_2O_3$. The presence of the $Al_2O_3$ is to be avoided if possible. It is therefore preferred to avoid generation of these oxide phases and to generate an oxide layer which is essentially totally liquid at the steel solidification temperature. However, a small proportion of such phases may be tolerated without significant pitting defects in the surface and it is possible to achieve good results if the liquid fraction in the oxide layer is at least 0.75. It is however, important to avoid those regions of the phase diagram labelled as $Al_2O_3$; $2SiO_2+3Al_2O_3$; and $SiO_2$. Accordingly, when casting an M06 steel it is preferred to have a melt free oxygen level in the range 50 to 100 ppm for melt temperatures in the range 1500° C. to 1675° C. More specifically, for a casting temperature of around 1600° C. the melt free oxygen level should be between 50 and 75 ppm whereas if the casting temperature is 1650° the free oxygen level should preferably be between about 80 ppm and 110 ppm. The free oxygen level of the steel may be controlled by trimming in the supply ladle prior to casting.

Figure 11:
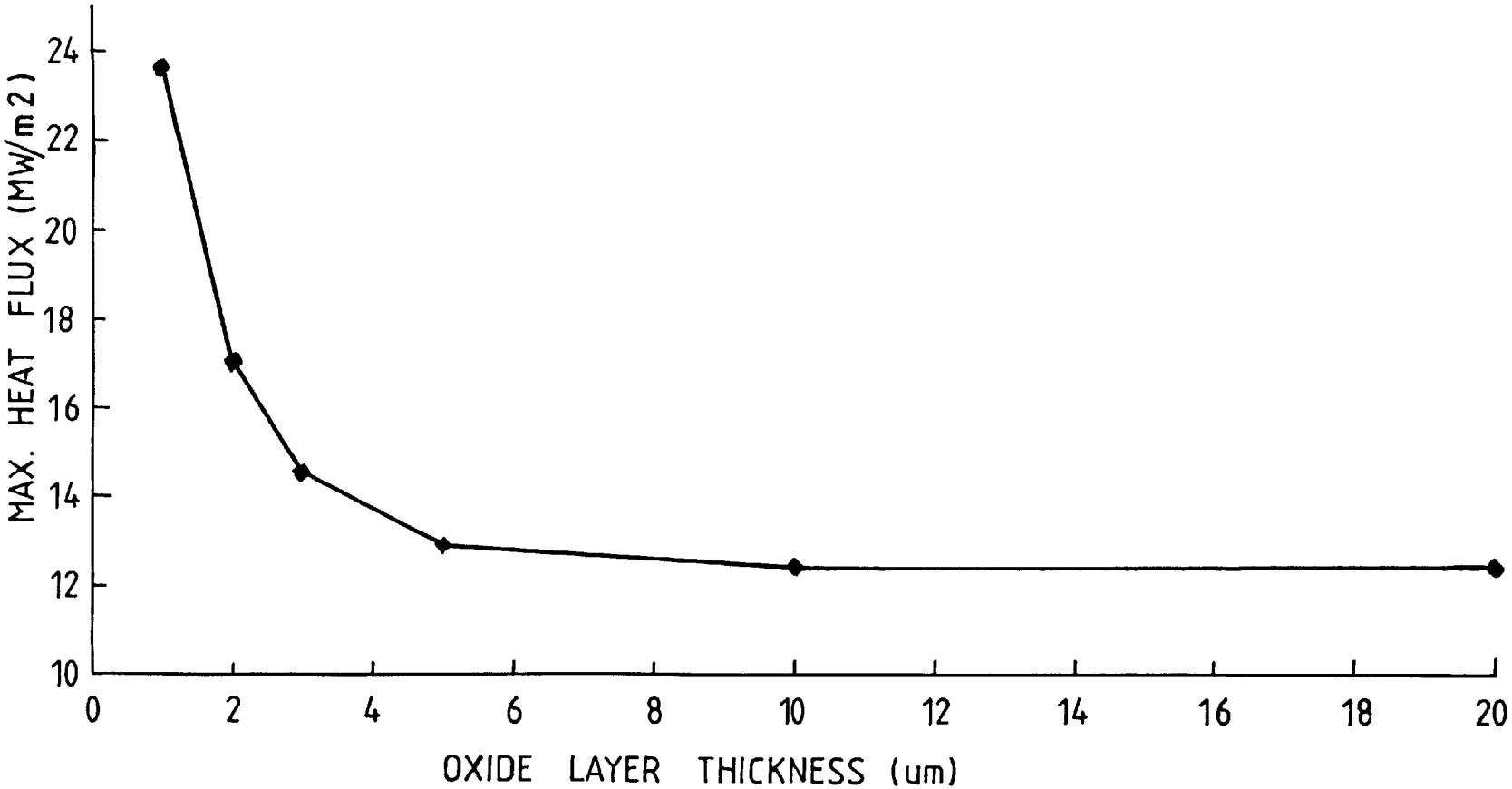
FIG. 11 illustrates the results of model calculations on the effect of the thickness of the surface layer.

Our experimental work has shown that the substantially liquid oxide layer which covers the substrate under strip cooling conditions is very thin and in most cases is of the order of 1 micron thick or less. Tests carried out in experimental apparatus simulating strip casting conditions show that both the substrate and the surface of the cast steel have particles of manganese and silicon compositions which must have solidified from the liquid layer. On each surface these particles have been at sub-micron levels indicating that the thickness of the liquid layer is of the order of 1 micron or less. Moreover, model calculations demonstrate that the thickness if the layer should not be more than about 5 microns so as to limit the resistance to heat flux due to the thickness of the layer. FIG. 11 plots the results of model calculations assuming perfect wetability. This supports the experimental observations and further indicates that the oxide layer should be less than 5 microns thick and preferably of the order of 1 micron thick or less.

Figure 12:
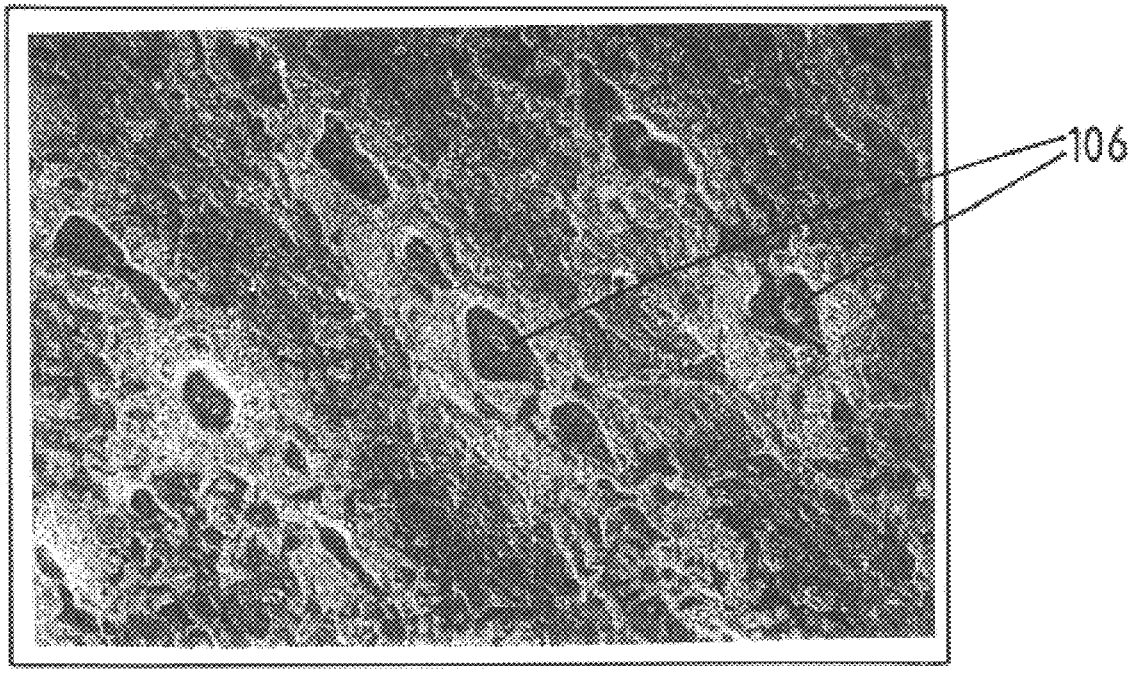
FIG. 12 is a SEN micrograph showing the surface of another cast strip.
Figure 13:
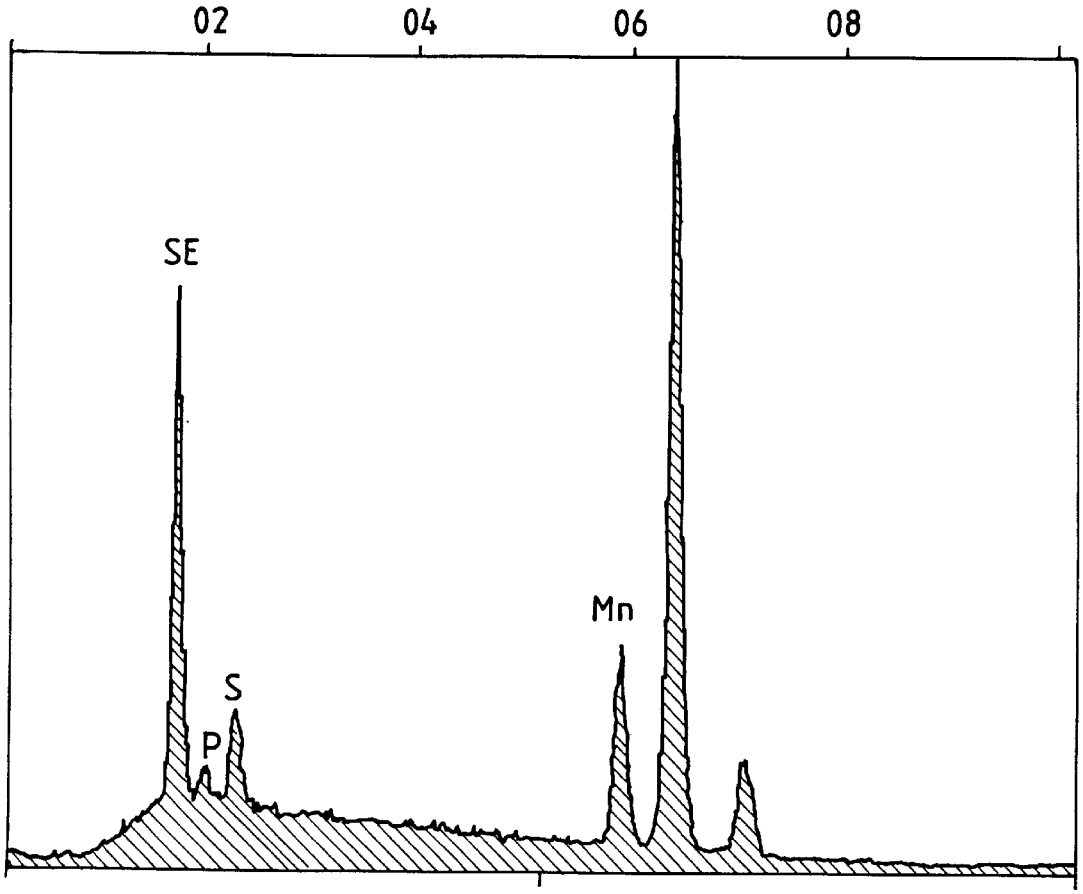
FIG. 13 shows the results of an x-ray microanalysis of material on the surface of the strip illustrated in FIG. 12.

The above results have been verified by the casting of many samples of steel strip in a twin roll caster of the kind illustrated. FIG. 12 is a SEN micrograph of a typical steel strip cast between casting rolls with a textured surface having a texture depth of 20 microns and a pitch between the ridges of 180 microns. This micrograph displays lines of nucleation sites indicated by the numeral 106 corresponding with the ridges in the texture of the casting rolls, these lines of nucleation sites running longitudinally of the strip. Between these nucleation sites the strip surface exhibits finely distributed particulate material. FIG. 13 is a qualitative energy dispersive x-ray microanalysis scan of this material indicating that it is comprises essentially of particles of manganese silicate. This indicates that as the strip surface was being formed the oxides in the melt were in the form of $MnO+SiO_2$ forming a thin layer on the casting rolls from which the manganese/silicon material was deposited initially in liquid form but subsequently solidifying with the formed steel strip without forming depressions of the kind encountered when solid oxides are deposited on the casting surfaces.

Examination of steel strip cast in the twin roll caster in accordance with this invention has produced evidence that the manganese silicate material produced by the thin liquid oxide layer on the rolls during solidification is present not only at the strip surface but is contained in a band of manganese silicate inclusions extending beneath the outer strip surface.

Figure 14:
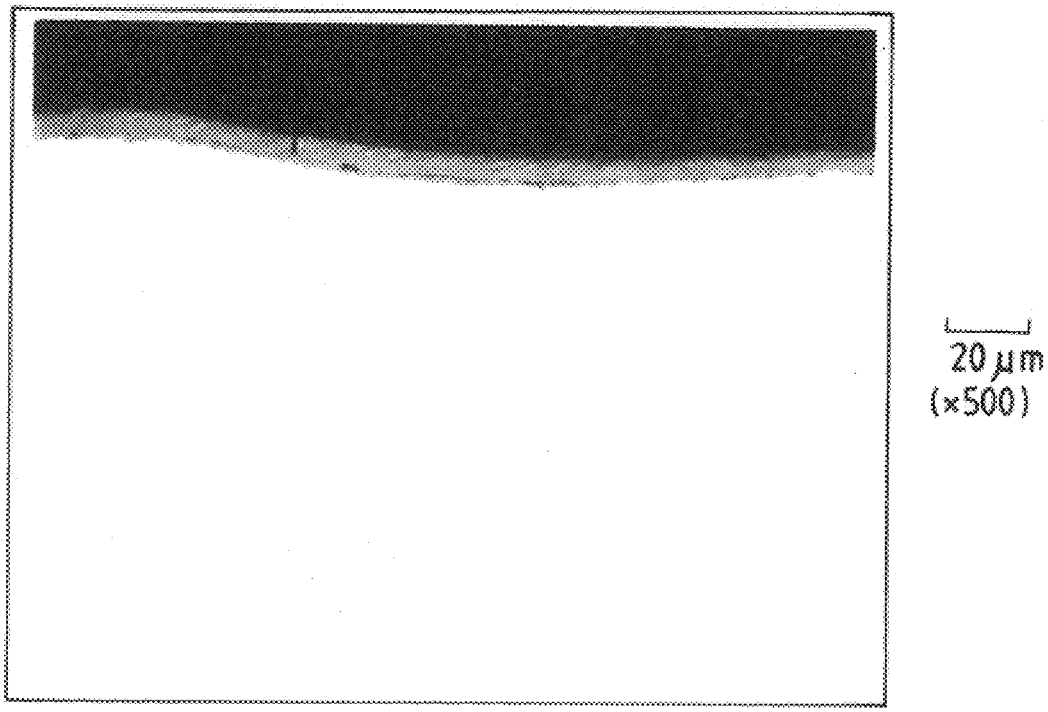
FIGS. 14 and 15 are photomicrographs showing a transverse section through the surface of a cast strip of M06 steel at differing magnifications.
Figure 15:
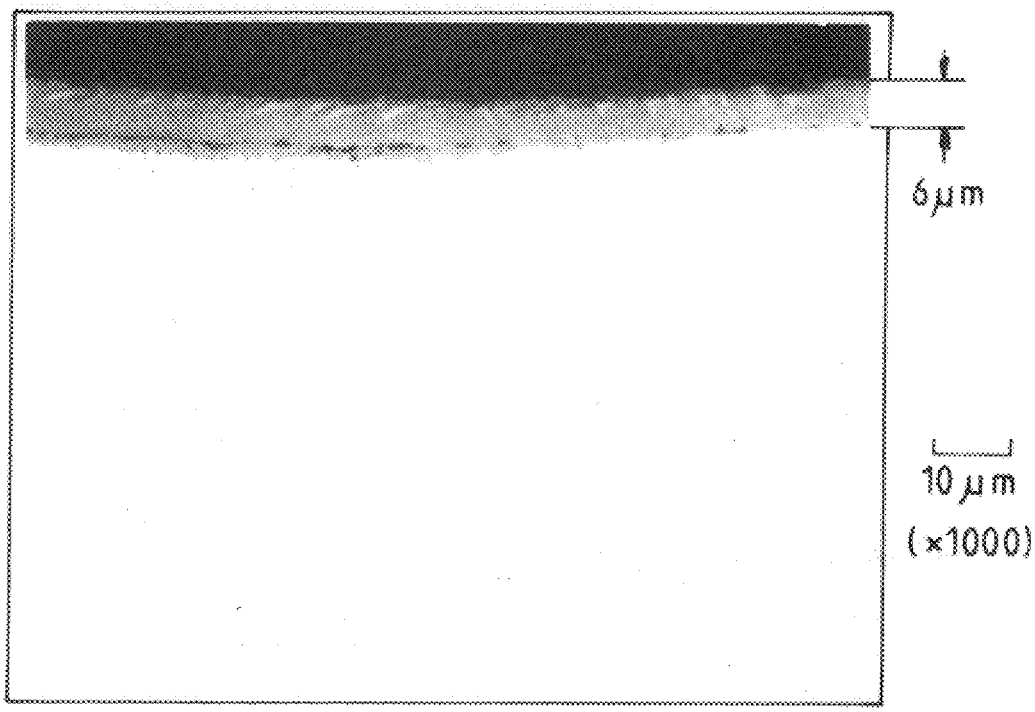

FIGS. 14 and 15 are photomicrographs showing a transverse section through the surface of a cast strip of M06 steel at magnifications of ×500 and ×1000 respectively cast under the following conditions:

| | |
|---|---|
| Carbon content of melt | 0.06% |
| Manganese content | 0.6% |
| Silicon content | 0.28% |
| Casting temperature | 1590° C. |
| Melt free oxygen | 55 ppm. |

Figure 16:
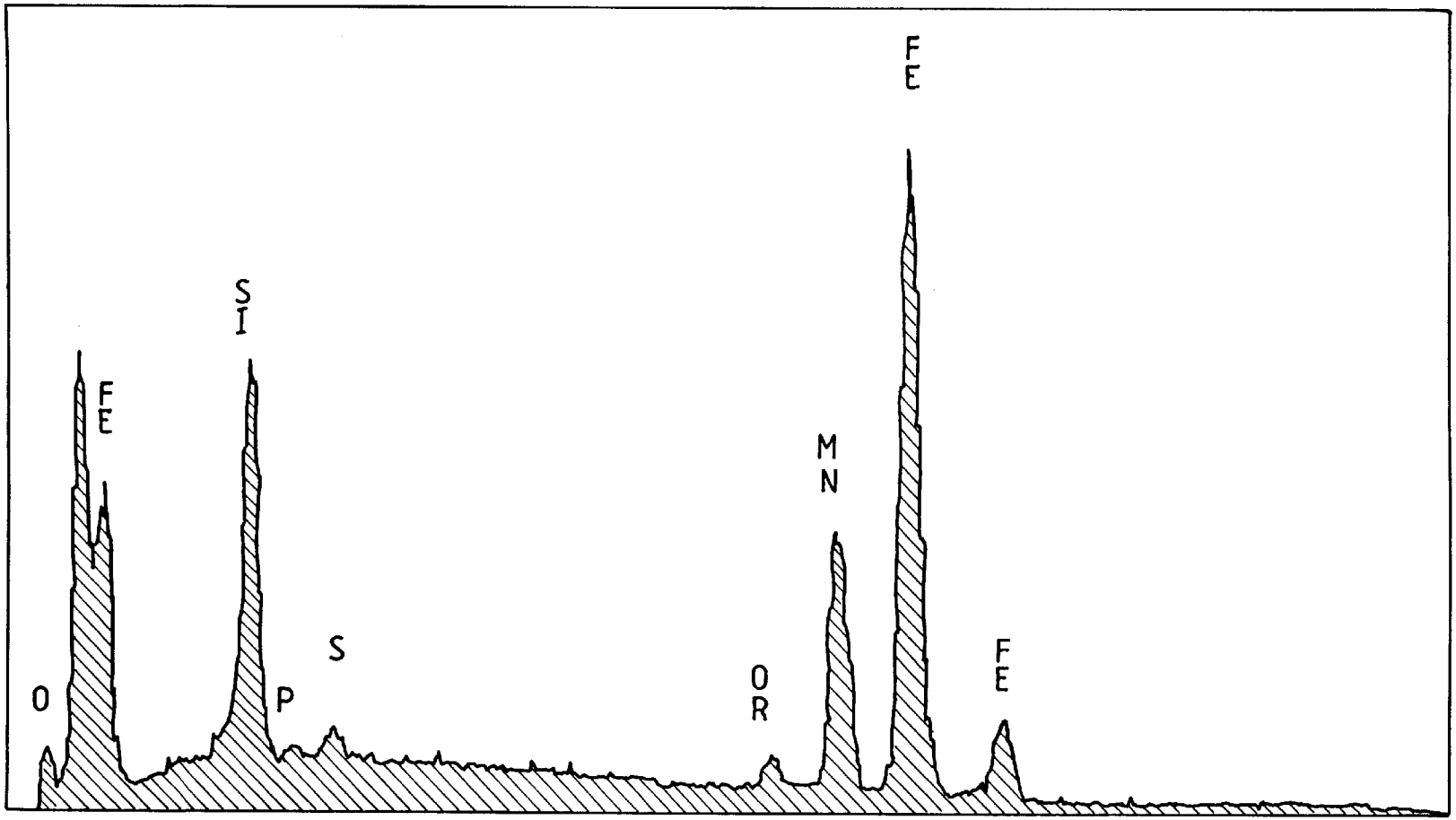
FIG. 16 shows the results of an x-ray analysis of a typical inclusion as seen in the strip of FIGS. 14 and 15.

These exhibit a normal surface of layer of scale indicated as X beneath which there is a narrow band of inclusions indicated as Y. Spectrographic analysis of the inclusions shows them to be composed essentially of manganese silicates having 20 to 50% silicon by weight. A typical analysis of one of the sub-surface inclusions is shown in FIG. 16. It has been found that these inclusions occur in a band extending to no more than 20 microns beneath the outer strip surface ie the surface of the outer layer of scale.

Aluminium killed steels such as A06 steel present particular problems in continuous strip casting operations, especially in twin roll casters. The aluminium in the steel produces significant quantities of solid $Al_2O_3$ in the de-oxidation products. As well as leading to clogging of the metal delivery system the solid oxide particles can be deposited on the casting surfaces to produce depression defects at the strip surface. We have determined that these problems can be alleviated by addition of calcium to the melt so as to produce CaO which in conjunction with $Al_2O_3$ can produce liquid phases so as to reduce the precipitation of solid $Al_2O_3$ .

Figure 17:
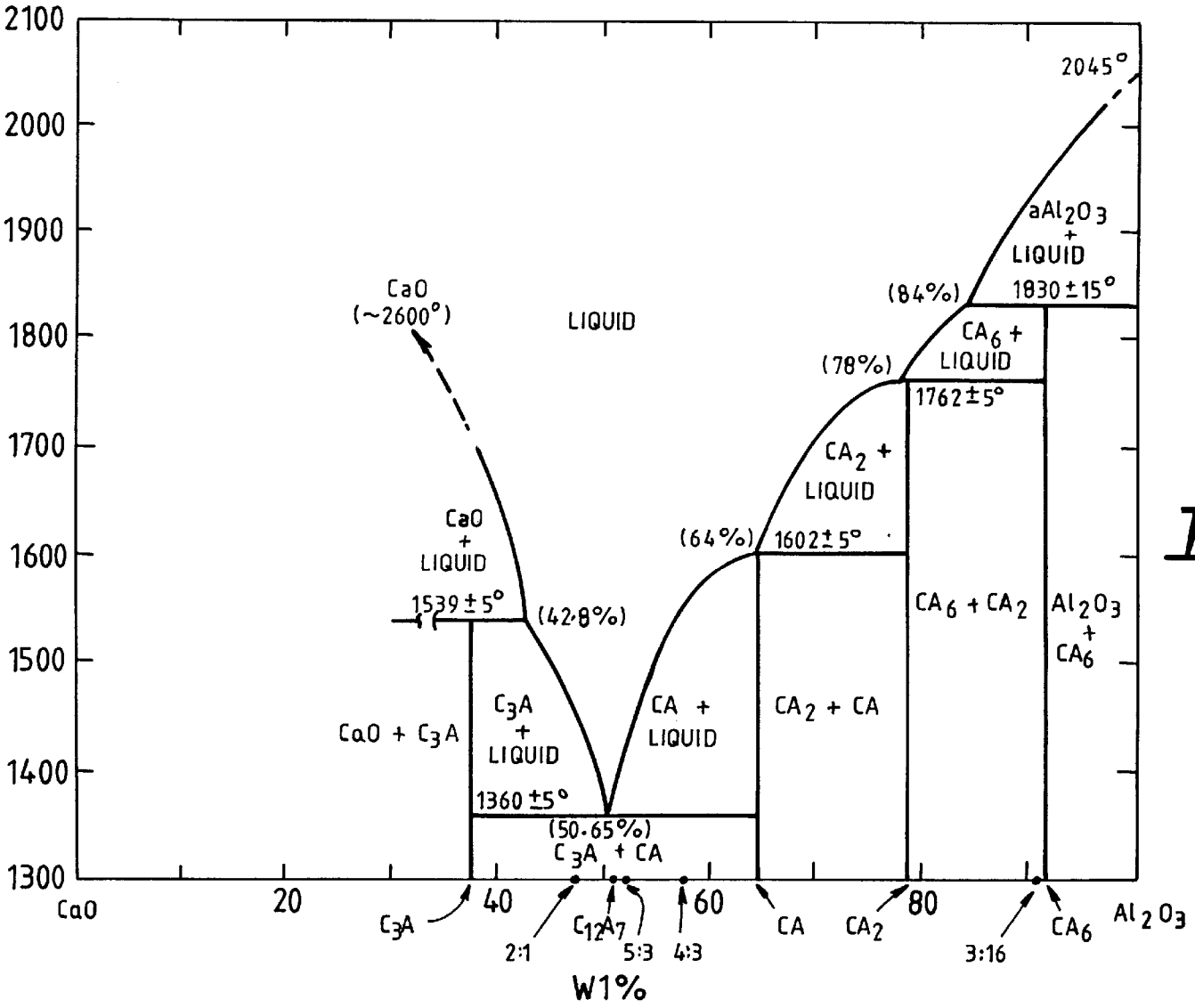
FIG. 17 shows the phase diagram of $CaO$-$Al_2O_3$ mixtures.

FIG. 17 shows the phase diagram of $CaO\text{-}Al_2O_3$ mixtures and it will be seen that the eutectic composition of 50.65% CaO has a liquidus temperature of 1350° C. Accordingly if the addition of calcium is adjusted to produce a $CaO\text{-}Al_2O_3$ around this eutectic composition this will produce liquid oxide phases and inhibit precipitation of $Al_2O_3$. The necessary calcium addition may conveniently be achieved by feeding calcium wire into the ladle 17.

Figure 18:
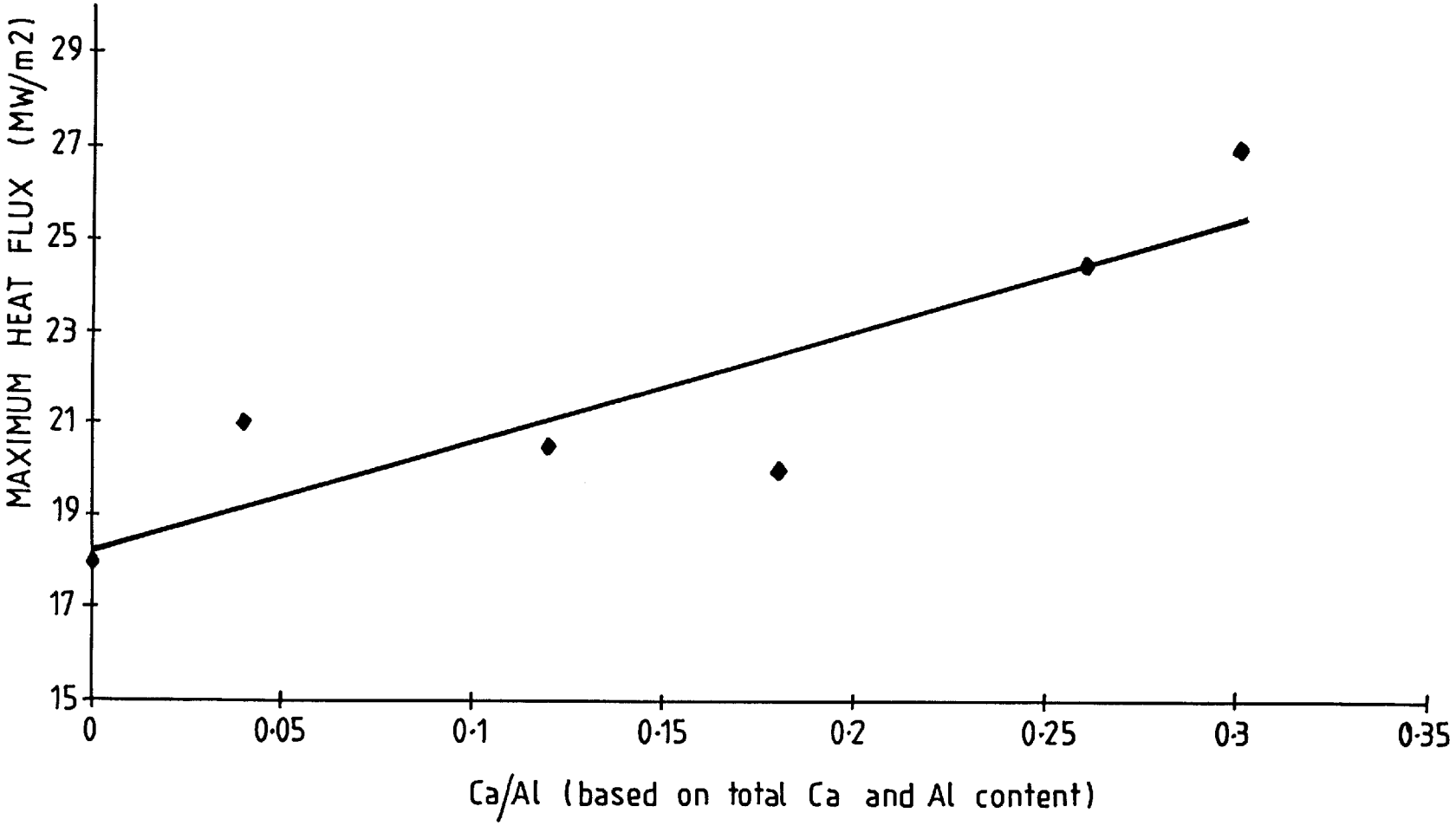
FIG. 18 shows the results of calcium additions on solidification of specimens from A06 steel melts.

In experimental apparatus simulating strip casting conditions, we have carried out solidification tests on a large number of A06 steel specimens with varying calcium additions on textured substrates at a melt temperature of 1595° C. In each case the substrate had a texture of parallel ridges having a depth of 20 microns and a pitch of 180 microns. In these tests we measured the maximum heat flux values obtained during solidification. The results of these tests are plotted in FIG. 18 and show that maximum heat flux is obtained when the Ca/Al is adjusted so that $CaO\text{-}Al_2O_3$ mixture is close to its eutectic. The increased heat flux obtained under the conditions confirm the presence of a liquid layer on the substrate which enhances heat transfer between the substrate and the solidifying metal. Examination of the solidified strips revealed that the presence of surface defects decreased with increased heat flux values and that the strips were substantially free of surface defects when the $CaO\text{-}Al_2O_3$ mixture was close to its eutectic.

Figure 19:
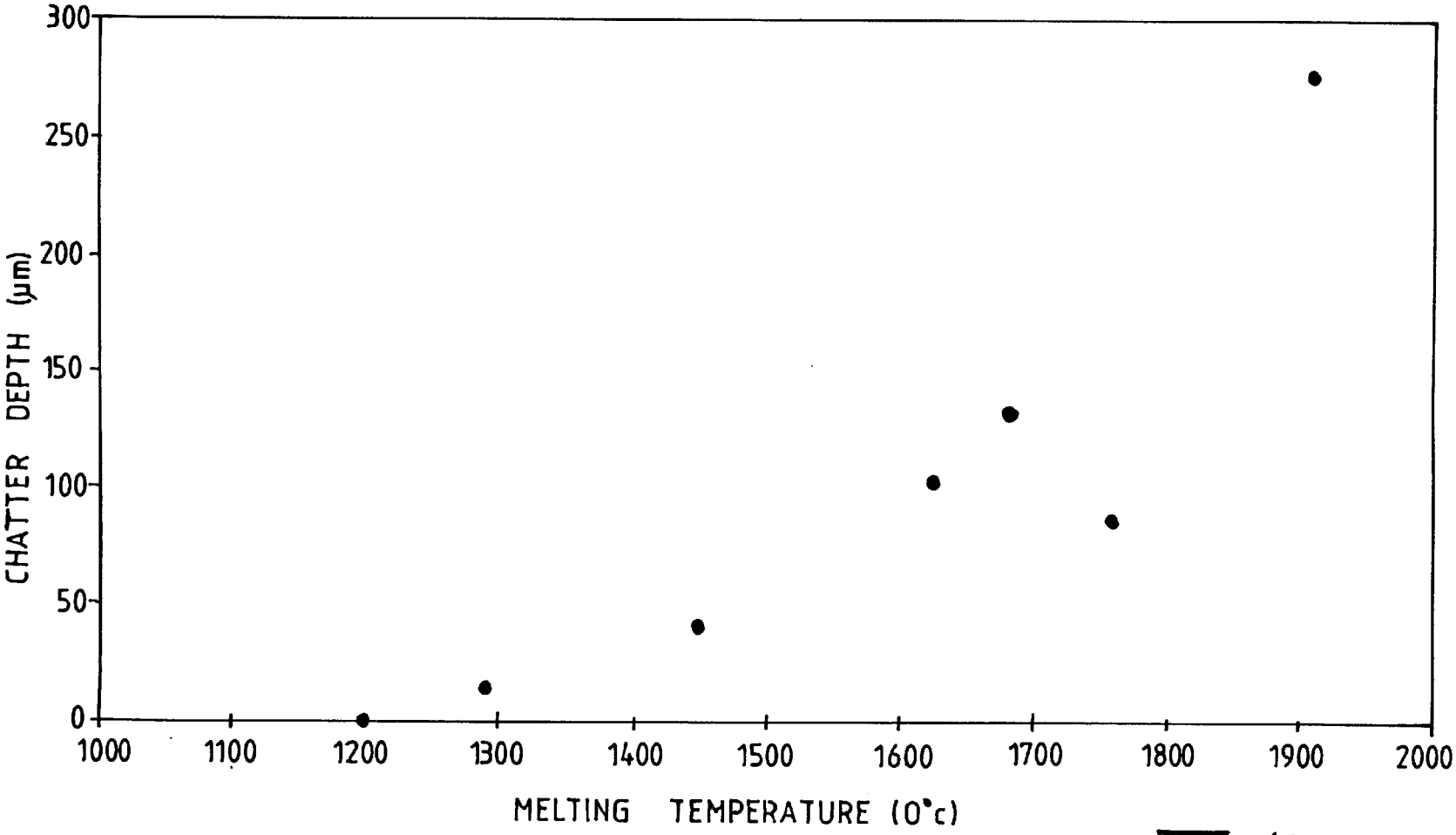
FIG. 19 shows the effect of the melting temperature of de-oxidation products on the formation of the defect known as "chatter".

FIG. 19 illustrates how the melting temperature of de-oxidation products in a steel melt can influence the formation of the "chatter" defect. More specifically it shows the chatter depth resulting from deposition of $MnO\text{-}SiO_2\text{-}Al_2O_3$ phases of differing melting temperatures. It will be seen that the severity of the defect increases with increasing melting temperature of the oxide phase that precipitates at the initial contact with the casting surface.

Our testing program has confirmed that a preferred M06 steel comprising to achieve optimum results is as follows:

| | |
|---|---|
| Carbon | 0.06% by weight |
| Manganese | 0.6% by weight |
| Silicon | 0.28% by weight |
| Aluminium | ≦0.002% by weight |
| Melt free oxygen | 60–100 ppm. |

It has further been determined that a suitable A06 composition to achieve optimum results with appropriate calcium addition is as follows:

| | |
|---|---|
| Carbon | 0.06% by weight |
| Manganese | 0.25% by weight |
| Silicon | 0.015% by weight |
| Aluminium | 0.05% by weight. |

I claim:

1. A method of casting steel strip comprising:

a) providing a chilled casting surface with a texture formed by a regular pattern of surface projections and depressions;

b) contacting the chilled casting surface with a casting pool of molten steel to cause solidification of steel from the casting pool onto the casting surface as a solidified shell, and c) separating the solid shell from the casting surface in a solidified strip; wherein the molten steel casting pool contains deoxidation products forming on the casting surface a layer of less than five microns thickness, a major proportion of which is liquid during cooling of the steel to below the liquidus temperature in the formation of said solidified shell.

2. A method as claimed in claim 1, wherein the liquid fraction of said layer is at least 0.75.

3. A method as claimed in claim 2, wherein said layer is substantially all liquid at temperatures below the liquidus temperature of the molten steel.

4. A method as claimed in claim 1, wherein the molten steel is a manganese/silicon killed steel with a controlled free oxygen level such that said layer is comprised essentially of a mixture of MnO and $SiO_2$ at the casting temperature.

5. A method as claimed in claim 4, comprising the step of controlling said free oxygen level by trimming in a molten metal supply ladle prior to casting.

6. A method as claimed in claim 1, wherein the molten steel is an aluminium killed steel with a purposeful addition of calcium to control the formation of solid $Al_2O_3$ therein.

7. A method as claimed in claim 6, wherein the formation of solid $Al_2O_3$ at casting temperatures is controlled by feeding calcium into a molten metal supply ladle prior to casting.

8. A method of continuously casting steel strip comprising:

a) introducing molten steel into a nip between a pair of parallel chilled casting rolls to form a casting pool of the molten metal supported on the casting surfaces of the rolls immediately above the nip, said casting surfaces being textured by a regular pattern of surface projections and depressions;

b) rotating the rolls to cause solidified steel shells forming on the casting surfaces in contact with the casting pool to be brought together into a solidified steel strip delivered downwardly from the nip; and c) forming on each of the casting surfaces during metal solidification a layer of oxide material, a major proportion of which is liquid during cooling of the steel to below its liquidus temperature in the formation of said shells, said molten steel having a composition selected so as to form said oxide material from the molten steel, said oxide material being deposited on the casting surfaces by the rotation of the rolls in contact with the molten steel to form said layer, said oxide material forming liquid oxide phases at the casting temperature to produce said major proportion of liquid in the layer.

9. A method as claimed in claim 8, wherein the liquid fraction of said layer is at least 0.75.

10. A method as claimed in claim 9, wherein said layer is substantially all liquid at temperatures below the liquidus temperature of the steel.

11. A method as claimed in claim 8, wherein the molten steel is a manganese/silicon killed steel with a controlled free oxygen level to produce a deoxidation product in the casting pool comprising essentially manganese and silicon oxides, each said layer comprises a mixture of essentially manganese and silicon oxides deposited on the respective casting roll from the deoxidation product, and the proportion of manganese and silicon oxides in the deoxidation product is such that the layer comprises liquid manganese and silicon oxide phases.

12. A method as claimed in claim 11, wherein the deoxidation product contains MnO to $SiO_2$ in proportions of about 45% to 75% MnO.

13. A method as claimed in claim 11, wherein the steel melt is generally of the following composition:

| | |
|---|---|
| Carbon | 0.06% by weight |
| Manganese | 0.6% by weight |
| Silicon | 0.28% by weight |
| Aluminium | ≦0.002% by weight. |

14. A method as claimed in claim 8, wherein the steel melt is an aluminium killed steel with a purposeful addition of calcium to control the formation of solid $Al_2O_3$ therein.

15. A method as claimed in claim 14, wherein the proportion of calcium to aluminium in the melt is in the range 0.2 to 0.3 by weight.

16. A method as claimed in claim 14, wherein the deoxidation product contains CaO to $Al_2O_3$ in proportions of 42% to 60% CaO.

17. A method as claimed in claim 15, wherein the steel melt in the casting pool is generally of the following composition:

| | |
|---|---|
| Carbon | 0.06% by weight |
| Manganese | 0.25% by weight |
| Silicon | 0.15% by weight |
| Aluminium | 0.05% by weight. |

18. The method of claim 14, comprising feeding calcium into a molten metal supply ladle prior to casting to control the formation of solid $Al_2O_3$.

19. A method as claimed in claim 8, wherein the casting rolls are chrome plated so that the casting surfaces are chromium surfaces.

20. A method as claimed in claim 8, wherein the said layer is less than 1 micron thick.

21. A method of casting steel strip comprising:

a) providing a chilled casting surface with a texture formed by a regular pattern of surface projections and depressions;

b) contacting the chilled casting surface with a casting pool of molten steel to cause solidification of steel from the casting pool onto the casting surface as a solidified shell; and c) separating the solid shell from the casting surface in a solidified strip; wherein the composition of the molten steel is selected to generate, in the casting pool, deoxidation products which form on the casting surface a layer of less than five microns thickness, a major proportion of which is liquid during cooling of the steel to below the liquidus temperature in the formation of said solidified shell.

* * * * *